US005799590A

United States Patent [19]

Noguchi

[11] Patent Number: 5,799,590

[45] Date of Patent: Sep. 1, 1998

[54] AIR SUPPLY SYSTEM FOR INCINERATOR APPARATUS

[75] Inventor: Takuya Noguchi, Kumamoto-ken, Japan

[73] Assignee: Sunny Industry Company, Limited, Kumamoto-ken, Japan

[21] Appl. No.: 746,971

[22] Filed: Nov. 19, 1996

Related U.S. Application Data

[63] Continuation-in-part of Ser. No. 421,433, Apr. 12, 1995, abandoned.

[30] Foreign Application Priority Data

| | | | |
|---|---|---|---|
| Apr. 13, 1994 | [JP] | Japan | 6-5209 |
| May 23, 1994 | [JP] | Japan | 6-133692 |
| Aug. 12, 1994 | [JP] | Japan | 6-212013 |

[51] Int. Cl.[6] ..... F23J 3/00

[52] U.S. Cl. ..... 110/216; 110/251; 110/259; 110/297; 110/165 R

[58] Field of Search ..... 110/257, 258, 110/259, 216, 297, 314, 165 R

[56] References Cited

U.S. PATENT DOCUMENTS

| | | | |
|---|---|---|---|
| 1,536,220 | 5/1925 | Jouclard | 110/251 |
| 1,952,227 | 3/1934 | Adams | 110/251 |
| 2,715,881 | 8/1955 | O'Neil | 110/251 |
| 3,824,935 | 7/1974 | Yamato et al. . | |
| 4,430,950 | 2/1984 | Foresto . | |
| 4,864,944 | 9/1989 | Engstrom et al. . | |
| 5,176,089 | 1/1993 | Jonsson . | |
| 5,245,936 | 9/1993 | Nakata | 110/251 |
| 5,452,669 | 9/1995 | Bailey . | |

*Primary Examiner*—Henry A. Bennett
*Assistant Examiner*—Susanne C. Tinker
*Attorney, Agent, or Firm*—Duane, Morris & Heckscher LLP

[57] ABSTRACT

Incinerator apparatus includes a furnace and a chimney in communication with the furnace. Within the furnace, a pipe having a bore and extending upward from the bottom of the furnace is disposed. The pipe is in communication with atmospheric air at the lower end thereof and is provided with a plurality of air holes therein. The pipe also includes a top air hole at the top end thereof. The top air hole has a transverse cross-sectional area smaller than that of the bore of the pipe. External air is spontaneously introduced from the outside of the furnace and flows out through the top air hole. As air flows out of the top air hole, it is also uniformly distributed through the air holes into the furnace and garbage to be burned in said furnace.

7 Claims, 15 Drawing Sheets

AIR SUPPLY SYSTEM FOR INCINERATOR APPARATUS

This is a continuation-in-part of application Ser. No. 08/421,433 filed on Apr. 12, 1995, now abandoned.

This invention relates to an incinerator for burning up various types of garbage and waste produced in homes and plants.

BACKGROUND OF THE INVENTION

Various types of incinerators for burning up industrial waste produced in plants and garbage from homes have been developed or proposed.

Waste such as plastic scraps and wasted tires burns at high temperature, and, therefore, it is burned in a large incinerator with complicated structure which is usually made of fire-brick.

Usually, garbage is a mixture of various matters and may contain a lot of water. Accordingly, in order to burn such garbage, a large incinerator apparatus with a stoker for feeding garbage to be burned is provided. A furnace of such incinerator apparatus is divided into a drying section and a burning section. Garbage is first fed into the drying section and, after being dried in the drying section, is fed into the burning section, whereby it is burned up as completely as possible to prevent or reduce pollution of the environment, particularly, air pollution.

An example of conventional incinerators is shown in FIG. 1. This incinerator includes a furnace section 15 in which a grate 17 is disposed. This conventional incinerator apparatus, however, has drawbacks. Garbage may be deposited in the furnace to close openings in the grate 17 so that flow of air is hindered. This causes imperfect combustion of garbage, and black smoke will pollute air. In addition, it is time-consuming and troublesome to remove garbage and ash from openings in the furnace grate. Further, garbage falling down into the space beneath the grate cannot receive sufficient heat from the garbage burning in the room above the grate and, therefore, cannot burn well, because the grate intercept the heat.

In order to improve the supply of air into the furnace, another prior art incinerator apparatus may be provided with a pipe 6 with a plurality of air holes 2 in addition to the grate 17. The pipe 2 has a pipe portion which extends horizontally along the surface of the base of the furnace in the direction normal to the plane of the sheet of FIG. 1, and its remote end is connected to an air blower (not shown) which is disposed outside the furnace 15, but the use of such blower and pipe requires extra cost and energy.

An incinerator apparatus shown in U.S. Pat. No. 3,824,935 issued to Y. Yamato et al. does not include a grate, but it includes a vertically extending rotary tube having its lower end connected to a blower. This rotary tube does not have air feeding holes therein.

Another incinerator apparatus is shown in U.S. Pat. No. 4,430,950 issued to S. Foresto et al. It includes a grate and vertically extending tubes into which air is fed from the lower ends thereof. Each of the tubes has holes in its side and top surfaces.

The hole in the top surface of each tube has a diameter equal to the inner diameter of the tube itself, and is covered by a cap. Air flowing out of the hole in the top surfaces of the tubes is scattered downward or horizontally, and, therefore, but for the blower, air cannot efficiently flow out through the holes in the side walls of the tubes.

The present invention can solve the above-described problems. An object of the present invention is to provide an incinerator which uses neither a grating nor a blower. According to the present invention, any problems attributable to the use of a grating can be eliminated. Rather, although neither a grating nor a blower is used, a sufficient amount of air is supplied into an incinerator furnace or even into garbage in the furnace to thereby enable perfect combustion of garbage. Thus, clean air is discharged from a chimney of the incinerator apparatus, and, therefore, air pollution with soot from the incinerator is prevented or greatly reduced.

The incinerator according to the present invention is simple in structure and can be manufactured and installed at reduced costs.

SUMMARY OF THE INVENTION

According to one feature of the present invention, an incinerator apparatus (10; 210) includes a furnace (12; 12'; 218) formed by a furnace casing. The furnace casing includes a bottom base plate supported horizontal on a floor with a space formed between the base plate and the floor, and a peripheral wall. The base plate and the peripheral wall form a furnace chamber. The incinerator apparatus also includes a chimney (14; 78; 220) communicating with the furnace at an upper portion of the furnace, and an air supply hole (42; 246*a*) extending through the bottom plate and communicating with the space beneath the bottom plate. An air supply pipe (16; 248) having a bore extending therethrough and having a given transverse cross-sectional area over substantially the entire length thereof extends upward within the furnace chamber with the lower end thereof communicating with the air supply hole in the bottom plate. The air supply pipe has a number of air holes (20; 252) formed through the peripheral wall of the pipe. The bore of the air supply pipe has a reduced transverse cross-sectional area at the top end of the air supply pipe to provide a top air hole (19; 253) in the top end of the air supply pipe. Air can flow spontaneously out of the pipe through the air hole upward toward the upper portion of the furnace chamber at which the chimney is connected. The flow of air through the top air hole in the pipe causes air to flow out also through the peripheral air holes in the pipe. The incinerator apparatus does not include a grate nor a blower for feeding air into the furnace chamber. With this arrangement, garbage on the bottom plate receives sufficient heat and burns well.

DETAILED DESCRIPTION OF PREFERRED EMBODIMENTS

Figure 1:
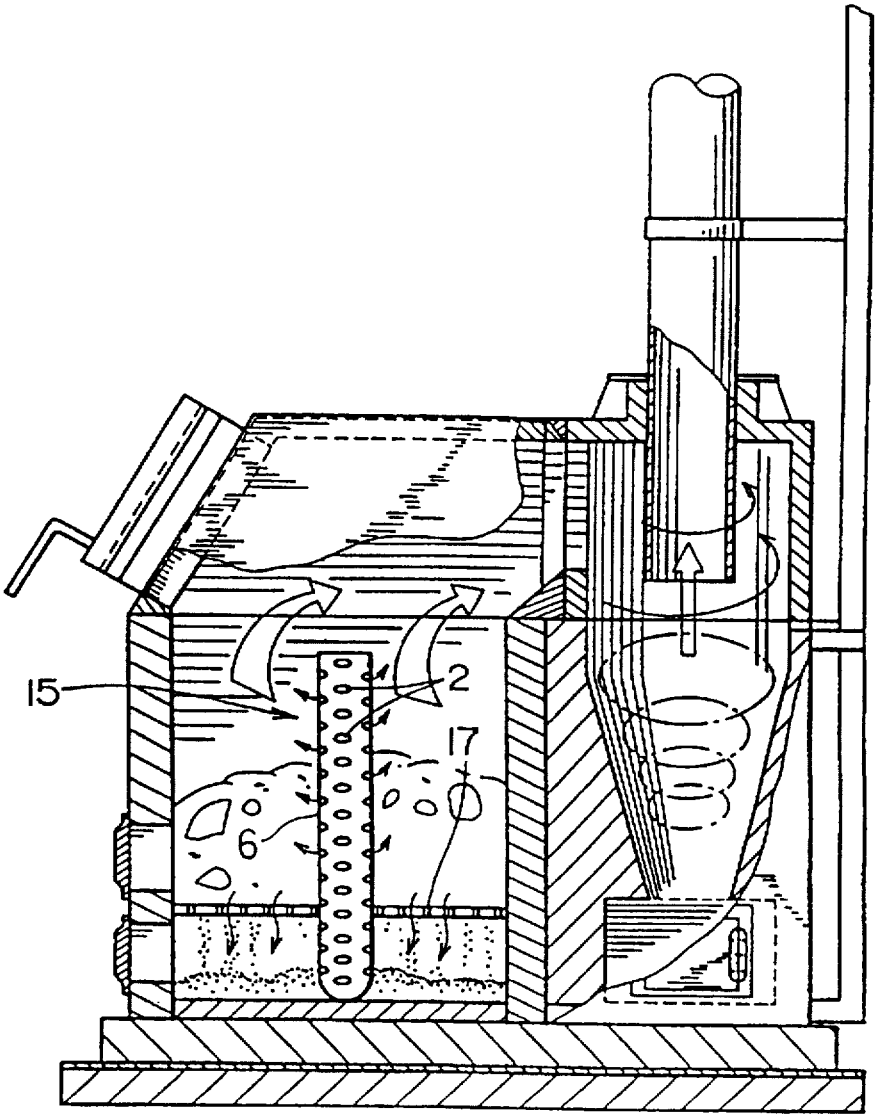
FIG. 1 Prior Art
FIG. 1 is a cross-sectional view of a prior art incinerator apparatus.

Now, the present invention is described by means of preferred embodiments shown in the accompanying drawings.

FIGS. 2, 3, 4 and 5 show an incinerator apparatus according to a first embodiment of the present invention. The incinerator apparatus is generally designated by a reference numeral 10. The incinerator apparatus 10 comprises a furnace 12 and a chimney 14 located above the furnace 12 and communicating with the furnace 12.

The chimney 14 is supported by a support post 50. The furnace 12 includes a rectangular furnace casing 26 having a bottom plate 36, and a truncated pyramidal roof 28 disposed on top of the furnace casing 26. The furnace casing 26, including the bottom plate 36, and the roof 28 may be made of a fireproof material, such as firebrick and castable refractory. A castable refractory comprises, for example, a mixture of alumina cement and powdery firebrick materials. The outer surfaces of the fireproof furnace casing and roof are coated with heat resistant metal sheets. The joints between the metal sheets are reinforced by angled iron bars.

It should be noted that the shape of the furnace casing is not limited to rectangle, but may be circular or polygonal.

Figure 4:
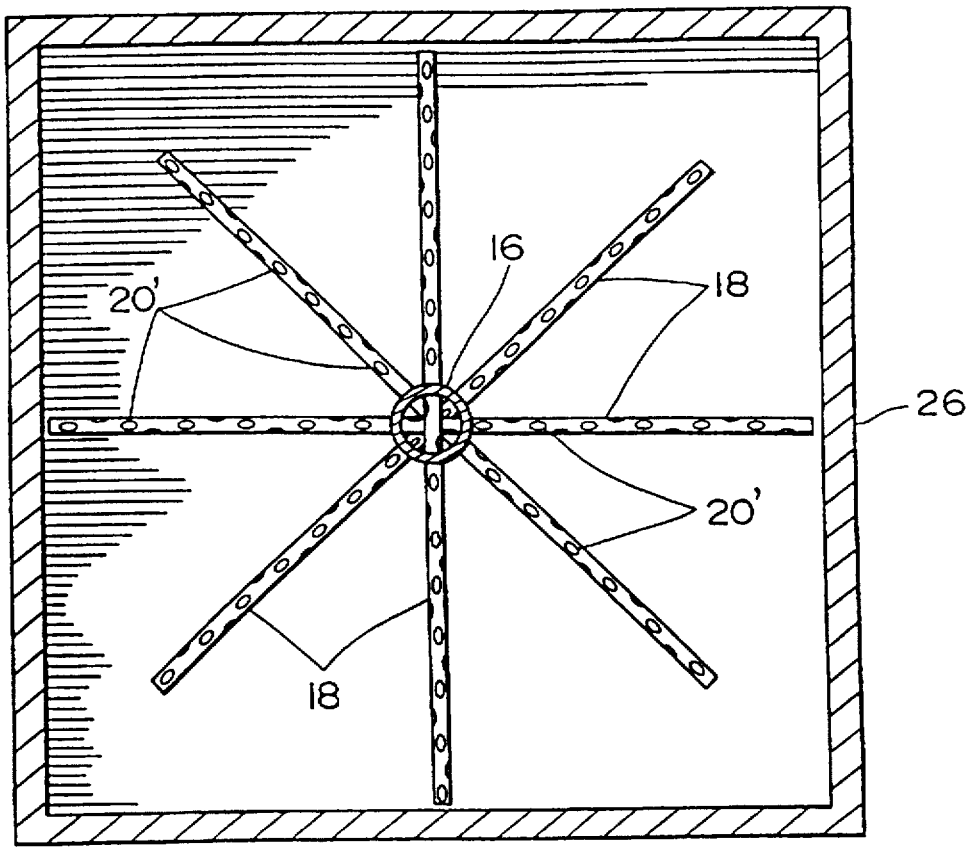
FIG. 4 is a cross-sectional view along the line 4—4 in FIG. 3.
Figure 5:
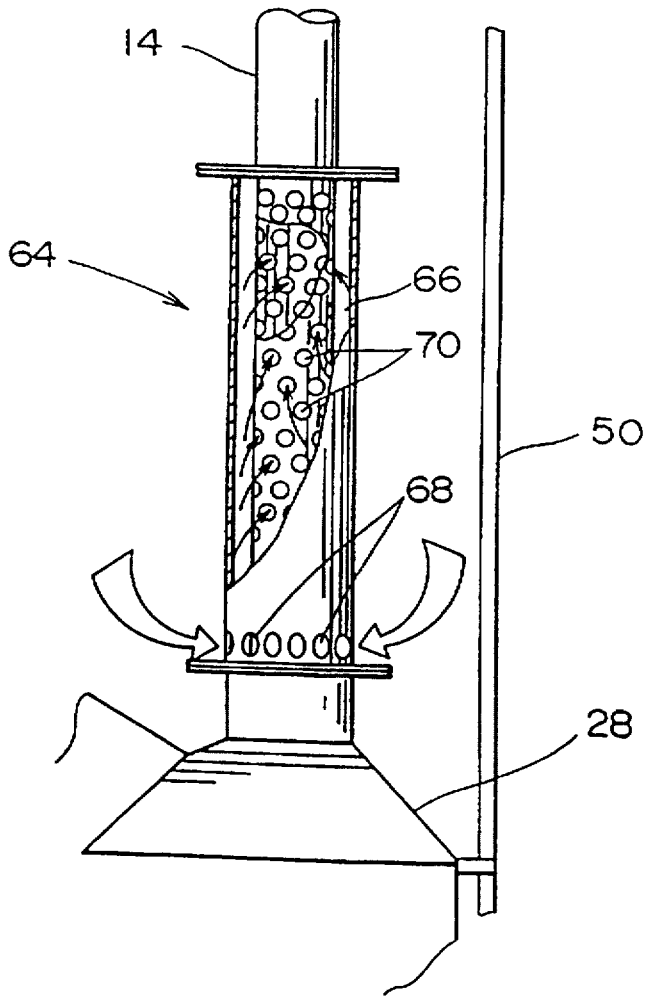
FIG. 5 is a partially cut-away view of part of a chimney, showing an air supply system provided in the chimney of the incinerator apparatus according to the present invention.

Within the furnace 12, an air supply pipe system is disposed. The air supply pipe system includes a main pipe 16 which extends upward from substantially the center of the bottom plate 36. The pipe 16 has a bore extending therethrough which has a given transverse cross-sectional area over substantially entire length of the pipe. The incinerator apparatus includes also a set of branch pipes 18 which extend radially, when viewed from the top or bottom side of the main pipe 16, from the main pipe 16 toward the peripheral wall of the furnace casing 26 (FIG. 4). The branch pipes radially project outward from the main pipe 16 at different heights. The set of branch pipes 18 are attached to the main pipe 16 in a relatively lower part of the main pipe 16. The main pipe 16 and the branch pipes 18 are provided with a number of air holes 20 and 20' extending therethrough, respectively.

Different from the conventional incinerator apparatus with a grate, garbage fed into the furnace 12 is supplied with sufficient air, when it is burnt, through the air holes 20 in the pipe 16 and through the air holes 20' in the branch pipes 18, so that it can burn up and resulting ash can smoothly move downward without closing the space between adjacent ones of the branch pipes. Thus, air can be uniformly supplied into the furnace 12 through the main and branch pipes 16 and 18 to keep the combustion within the furnace 12 perfect.

Figure 2:
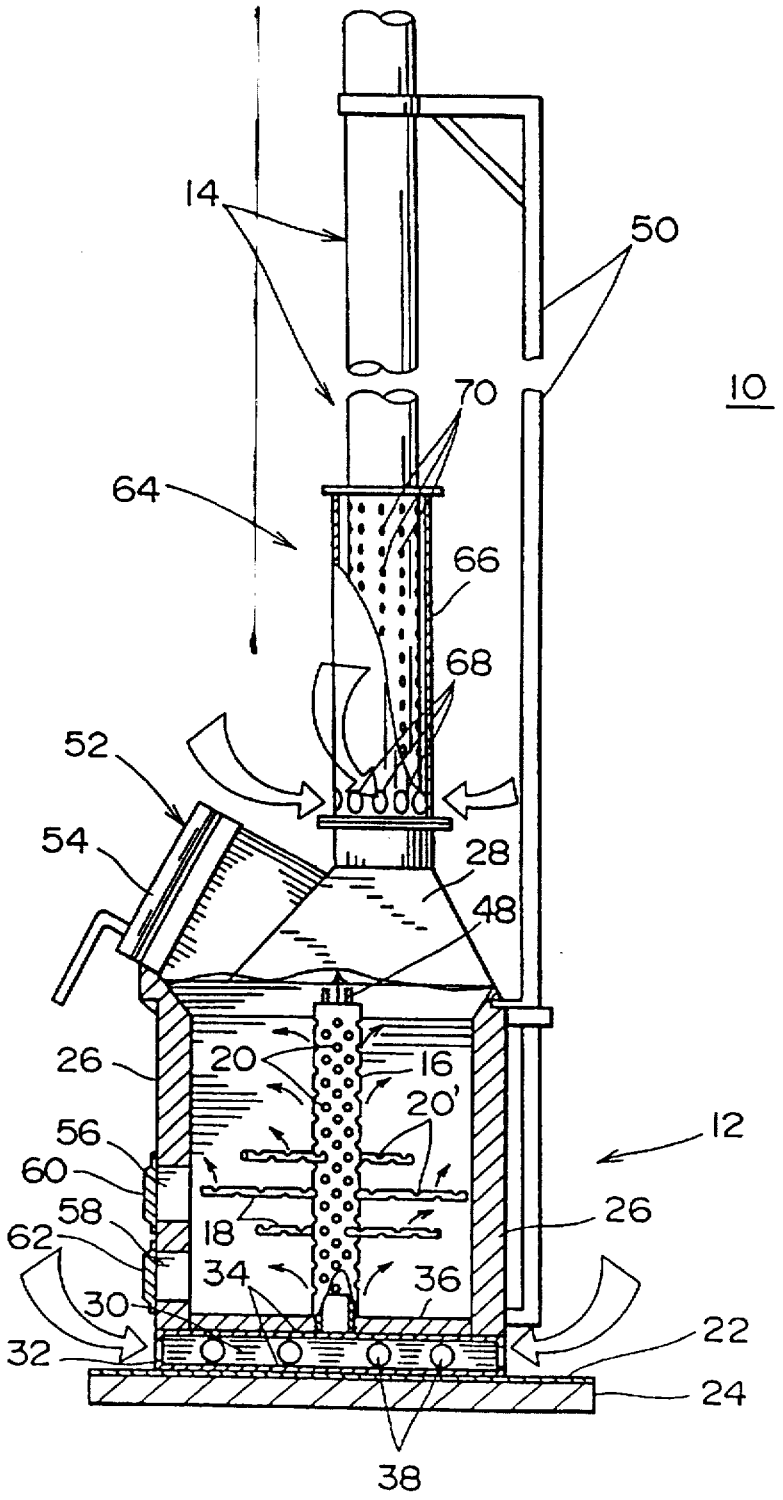
FIG. 2 is a partially cross-sectional side view of an incinerator apparatus according to a first embodiment of the present invention.

As shown in FIG. 2, the furnace 12 is installed on top of a planar heat resistant metallic plate 22 which, in turn, is disposed on a concrete base 24 on the ground.

Figure 3:
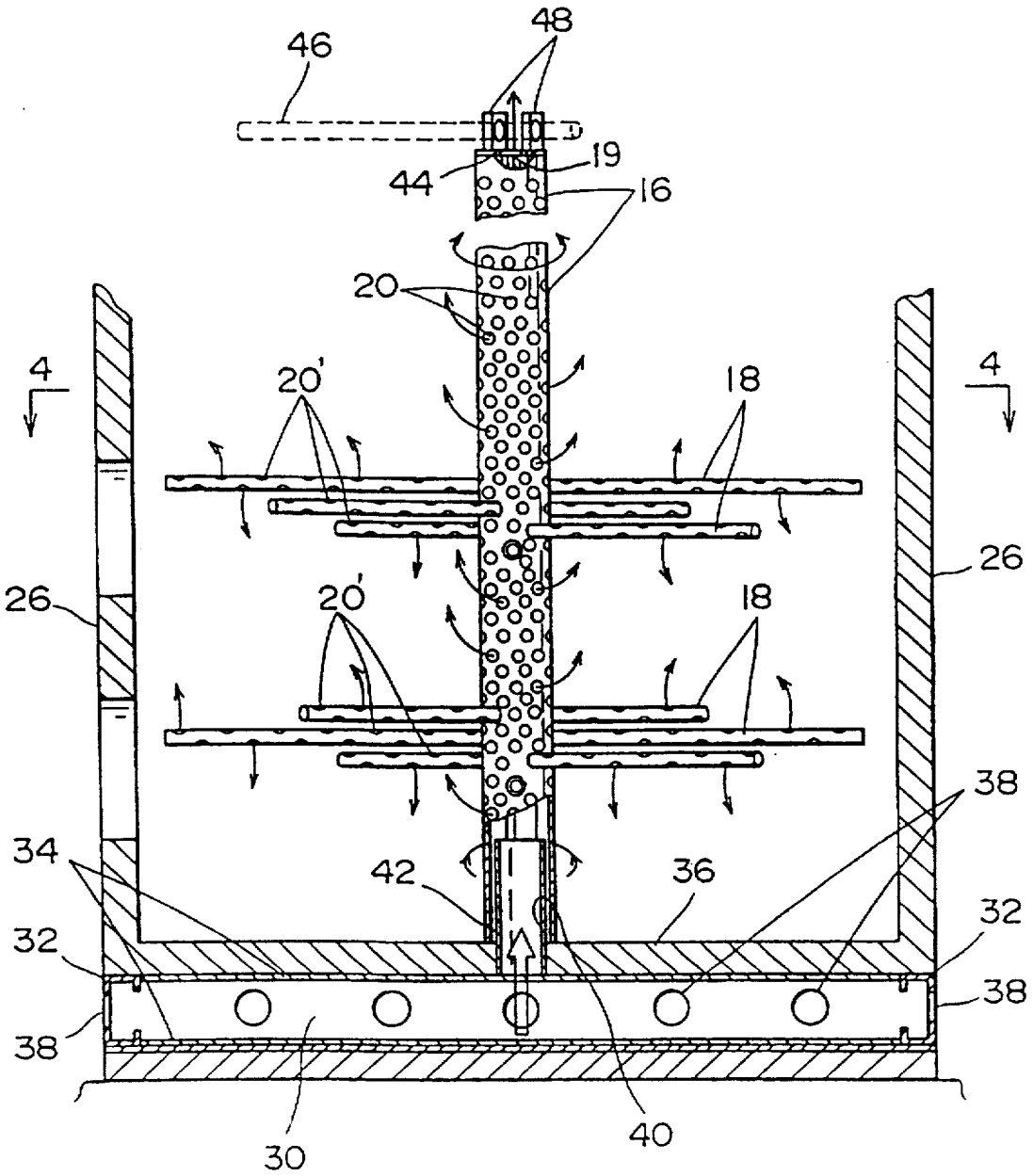
FIG. 3 is an enlarged cross-sectional view of part of the incinerator apparatus of FIG. 2.

As shown in FIGS. 2 and 3, beneath the bottom plate 36 of the furnace casing 26, there is disposed an air chamber 30 which is in communication with the environment. The air chamber 30 is formed by means of a metallic frame 32, which may be of heat-resistant metal, such as iron, secured to the bottom of the furnace 12, i.e. the bottom plate 36, and disposed on the heat resistant metallic plate 22, and a pair of metallic plates 34, which may be also of heat-resistant metal, closing the top and bottom openings of the metallic frame 32. A plurality of air conducting openings 38 are formed in the metallic frame 32 so that air can automatically enter into the air chamber 30 through the openings 38.

As shown in FIG. 3, a joint pipe 40 is secured to the upper one of the metallic plates 34 at substantially the center thereof. The joint pipe 40 extends upwards. The bottom end of the main pipe 16 is fitted over the joint pipe 40 so that the main pipe 16 can rotate about the longitudinal axis of the joint pipe 40 and, thus, about the longitudinal axis of the main pipe 16.

The main pipe 16 is formed of a heat resistant metal, and it is open at an opening 42 at its bottom end so that the pipe 16 can be telescopically fitted over the joint pipe 40. A top plate 44 with an air hole 19 formed therein is disposed to close the top end opening of the main pipe 16. Instead of using the plate 44, the top end of the main pipe 16 may be reduced into the air hole 19 by any means.

From six to eight such air holes 20 are formed at respective levels along the main pipe 16. One of the aforementioned branch pipes 18 is inserted into one of the holes 20 and extend out through the diametrically opposite hole 20. Similarly, another one of the branch pipes 18 extends through the pipe 16 through two diametrically opposite holes 20 at a different level, and so forth.

When viewed from the top or bottom side of the air supply pipe system comprising the main pipe 16 and the branch pipes 18, a set of up to six to eight branch pipes 18 extend radially, i.e. they are angularly spaced from each other as better shown in FIG. 4. Depending on the size and purpose of the incinerator apparatus, a plurality of such sets of branch pipes 18 may be provided on the main pipe 16, as shown in FIG. 3.

Air flows from the outside of the furnace, through the openings 38 in the metallic frame 32 of the air chamber 30, and through the joint pipe 40 upward into the main pipe 16. Air flowing upward through the main pipe 16 goes out through the air holes 20 into the furnace casing 26.

The diameter, and, hence, the aperture area or transverse cross-sectional area of the air hole 19 in the plate 44 on top of the main pipe 16 are appropriately determined to be smaller than the inner diameter and, hence, the transverse cross-sectional area of the bore in the main pipe 16. The diameter of the hole 19 is typically larger than the diameter of the air holes 20 and 20' of the main and branch pipes 16 and 18, which is, for example, 1 cm. With this arrangement, when garbage within the furnace chamber is burning, air flowing from the air chamber 30 into the main pipe 16 is heated and flows as an updraft. The air then is smoothly jetted out upward through the air hole 19 in the top plate 44. The jetted air is not scattered in the horizontal direction, but it flows upward toward the chimney 14. As air flows upward through the air hole 19, air flowing through the bore in the main pipe 16 also flows smoothly out into the furnace chamber through the air holes 20 and 20'. The inventor found that if the size of the air hole 19 is too large or too small, the amount of air flowing out into the furnace chamber through the air holes 20 and 20' becomes smaller. The size of the air hole 19 should be determined empirically depending on the type of the incinerator. The inventor has made experiments and found that for the main pipe 16 having an inner diameter of about 5.3 cm (corresponding to the cross-sectional area of the bore of about 22 $cm^2$), the optimal diameter of the air hole 19 is about 1.5 cm (corresponding to the cross-sectional area of the air hole 19 of about 1.8 $cm^2$), and for the main pipe 16 having an inner diameter of about 13 cm (corresponding to the cross-sectional area of the bore of about 134 $cm^2$), the optimal diameter of the air hole 19 is about 2 cm (corresponding to the cross-sectional area of the air hole 19 of about 3.1 $cm^2$) is suitable for the air hole 19, and the optimal diameter of the air hole 19 for the main pipe 16 having an inner diameter of values between about 5.3 cm and about 13 cm is between about 1.5 cm to about 2 cm. In other words, the ratio in area of the air hole 19 to the bore of the main pipe 16 is theoretically from about 10% to about 2%.

For example, for the main pipe 16 having an inner diameter of about 5.3 cm for use in small size incinerator apparatuses, the diameter of the air hole 19 is about 1.5 cm, and for the main pipe 16 having an inner diameter of about 13 cm for use in large size incinerator apparatuses, the diameter of the air hole 19 is about 2 cm. Thus, for the main pipes having a diameter in the range of from about 5.3 cm to about 13 cm, the ratio of the diameter of the air hole 19 to the inner diameter of the main pipe 16 is from about 28 to about 15% (the ratio in area being from about 8 to about 2%).

As the inner diameter of the main pipe 16 is larger, the diameter of the air hole 19 is larger, but as the inner diameter of the main pipe 16 is larger, the ratio of the diameter of the air hole 19 to the inner diameter of the main pipe 16 tends to be smaller.

On top of the plate 44, one or more studs 48 with a hole therethrough are secured, as shown in FIG. 3. A bar, for example, 46 can be inserted through the holes in the studs 48 to rotate the main pipe 16 about the joint pipe 40 so that garbage and ash deposited on and around the branch pipes 18, which tend to close the air holes 20' in the branch pipes 18, can be easily removed from the branch pipes 18. Of course, any other suitable means may be used to rotate the pipe 16.

The branch pipes 18 are also formed of a heat resistant metal. Each of the branch pipes 18 has such an outer diameter that it can be inserted through a pair of diametrically opposite air holes 20 in the main pipe 16. The length of each branch pipe 18 is such that, when it is attached to the main pipe 16, the opposite ends of the branch pipe 18 can be located near the inner wall surface of the furnace casing 26. As described above, a number of air holes 20' are formed in each of the branch pipes 18. Different from the holes 20 in the main pipe 16, no hole is formed at and around a location diametrically opposite to each air hole 20' in the branch pipes 18.

FIG. 4 shows four branch pipes 18 inserted through respective pairs of diametrically opposite air holes 20 at four different heights along the length of the main pipe 16, with an angle of 45 degrees disposed between adjacent branch pipes. This enables garbage fed into the furnace 12 to rest on and be held by the branch pipes 18.

Those air holes 20' in the respective branch pipes 18 which are to be located within the interior of the main pipe 16 are formed to open downward so that air coming up from the air chamber 30 through the joint pipe 40 can diverge into the branch pipes 18 and be uniformly distributed into the furnace.

As described previously, two or more sets of such angularly disposed branch pipes may be used at different heights.

With the above-described arrangement, namely, by rotatably mounting the main pipe with the air holes 20 over the joint pipe 40 communicating with the air chamber 30 and radially arranging the branch pipes 18 in the lower part of the main pipe 16, garbage or waste to be burned which is fed into the furnace 12 are held by the branch pipes 18 and air can be substantially uniformly supplied into the furnace through the air holes 20 and 20' in the main and branch pipes 16 and 18. Thus, the combustion of garbage can be maintained efficiently.

As combustion of garbage held on the branch pipes 18 advances, residue of garbage smoothly drops so that it does not close the space between adjacent branch pipes 18. Therefore air can be supplied uniformly to achieve perfect combustion.

In case that burned residue closes the space between the branch pipes 18, the main pipe 16 may be rotated by means of the bar 46, for example, after the burning is over, to thereby remove such residue. If maintenance or cleaning of the furnace 12, the main pipe 16, and/or the branch pipes 18 is necessary, the branch pipes 18 may be pulled off from the main pipe 16 and, thereafter, the main pipe 16 can be pulled off from the joint pipe 40.

As shown in FIG. 2, the chimney 14 extends upward from the roof 28. The chimney 14 is formed of heat resistant material, such as heat resistant steel. The chimney 14 is supported by the support post 50 which, in turn, is secured to the rear surface of the furnace casing 26.

A garbage feeding opening structure 52 is formed in the front side of the roof 28, and is closed by a rid 54 with a handle by which the rid is operated. In the lower part of the front portion of the furnace casing 26, there are formed a firing window 56 and an ash removal opening 58, which are arranged vertically spaced from each other. The window 56 and the opening 58 are normally closed with doors 60 and 62, respectively. The firing window 56 is used to fire garbage fed through the garbage feeding opening structure 52, and ash and residue are removed through the opening 58.

An air supply section 64 is formed in the lower part of the chimney 14. As shown in greater detail in FIG. 5, the chimney air supply section 64 includes an air supply chamber 66 disposed around the outer surface of the chimney 14, air introducing openings 68 formed through the lower part of the cylindrical wall forming the air supply chamber 66, and air supply openings 70 formed through the chimney portion within the chamber 66.

Combustion gas resulting from the combustion of garbage in the furnace 12 goes up through the roof 28 into the chimney 14. Air introduced through the air introducing openings 68 into the air supply chamber 66 is pre-heated and flows through the air supply openings 70 into the chimney 14. The air is then mixed into the upward moving combustion gas to perfectly burn unburned gas or imperfectly burned gas contained in the combustion gas moving upward through the chimney 14.

As described in detail, the entire structure of the incinerator apparatus of the present invention, including the air supply pipe system and the chimney 14 with the air supply section 64, is very simple and, therefore, the apparatus can be installed at low costs.

The above-described incinerator apparatus 10 according to the present invention can be installed on the premises of a plant or in a yard of an individual's home to burn various types of waste. Garbage or other waste including plastic scraps is thrown into the furnace casing 26 through the garbage dumping structure 52 and the rid 54 is placed over the opening of the structure 52. Then, the garbage within the furnace casing 26 is fired through the window 56 to burn.

The garbage within the furnace casing 26 is held by the branch pipes 18 radially extending from the main pipe 16. As the combustion gas goes upward through the chimney, air from the air chamber 30 is automatically supplied through the air holes 20 in the main pipe 16 and through the holes 20' in the branch pipes 18 to flow through the garbage held by the branch pipes 18. Thus, burning of fired garbage is maintained.

The gas within the furnace casing 26 moves through the roof 28 upward into the chimney 14. Air pre-heated in the air supply chamber 66 in the air supply section 64 of the chimney 14 is supplied through the air supply openings 70 into the interior of the chimney 14 and is mixed with the gas moving upward through the chimney 14. This causes unburned or imperfectly burned gas to be burned perfectly so that the exhausted gas is perfectly burned gas which does not pollute air.

After a quantity of garbage has been burned, the handled rid 54 is removed, and the main pipe 16 can be rotated in opposite directions by means of, for example, the bar 46 around the axis of the joint pipe 40 so that residue and ash deposited on the radially arranged branch pipes 18 can be dropped on to the bottom of the furnace and removed through the ash removal opening 58. Thus, the space between adjacent branch pipes 18 are not stuffed with burned residue and/or ash. The branch pipes 18 and the main pipe 16 can be removed out of the furnace for the maintenance purpose.

FIGS. 6 through 10 show an incinerator apparatus 10*a* according to a second preferred embodiment of the present invention.

The incinerator apparatus 10*a* includes a furnace section 12' and a cyclone burning and dust collecting section 74 (hereinafter sometimes referred to simply as cyclone section) which is formed integral with the furnace section 12'. The furnace section 12' is basically similar in structure to the furnace 12 shown in FIGS. 2 through 5.

The cyclone section 74 is separated by a partition wall 72 from the furnace section 12'. The cyclone burning and dust collecting section 74 can be of any known structure.

The furnace section 12', like the furnace 12, includes a furnace casing, a roof, an air chamber, an air supply pipe system comprising a main pipe and branch pipes including air holes, which are substantially the same as those of the first embodiment shown in FIGS. 2 through 5 and, therefore, are represented by the same reference numerals used in FIGS. 2 through 5. Accordingly, no further explanation about them is given.

The incinerator apparatus including the furnace section 12' and the cyclone section 74 is installed on a planar plate 22 of heat resistant metal, which plate 22, in turn, is disposed on a concrete base 24.

Figure 6:
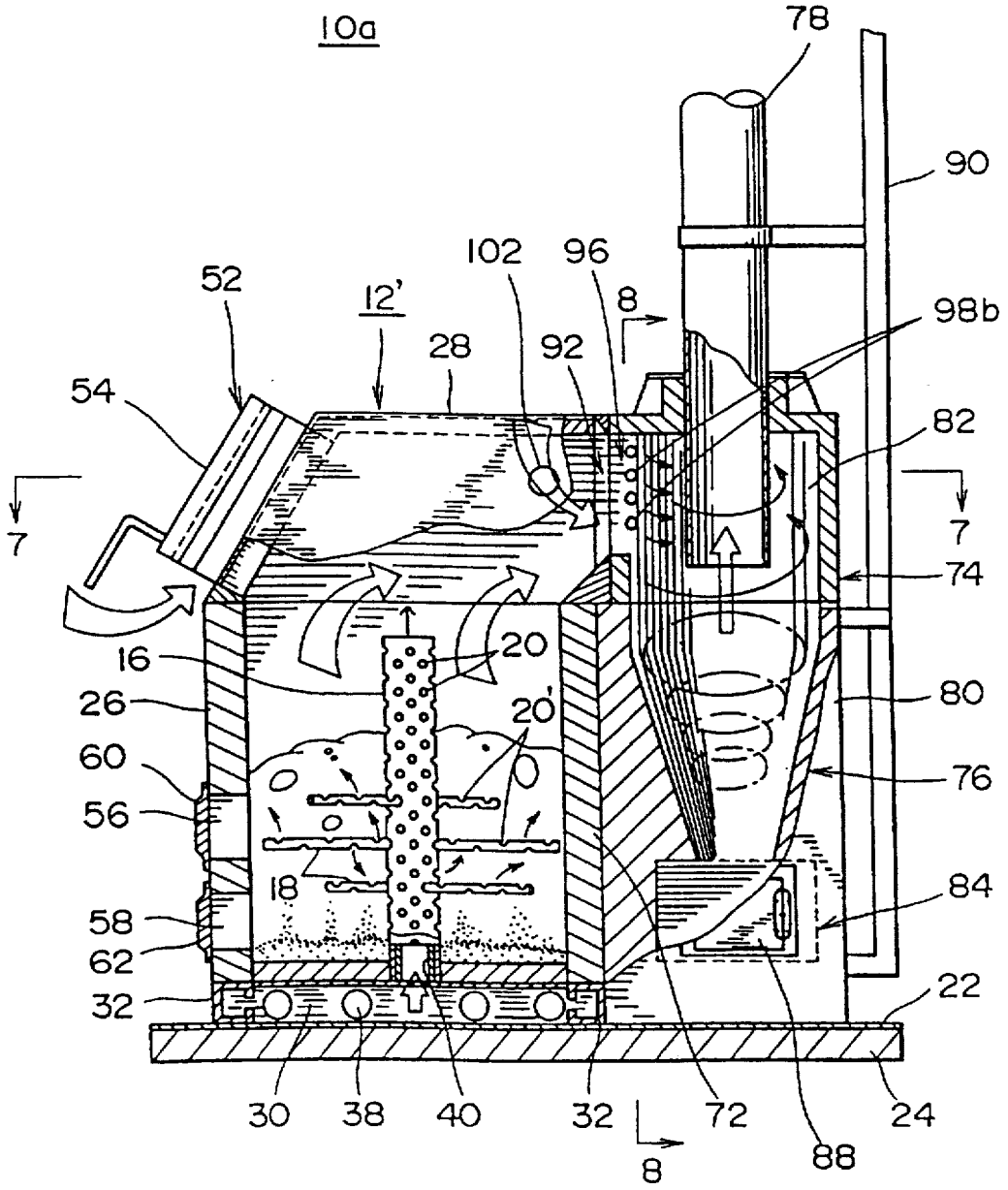
FIG. 6 is a partially cross-sectional side view of an incinerator apparatus according to a second embodiment of the present invention.
Figure 7:
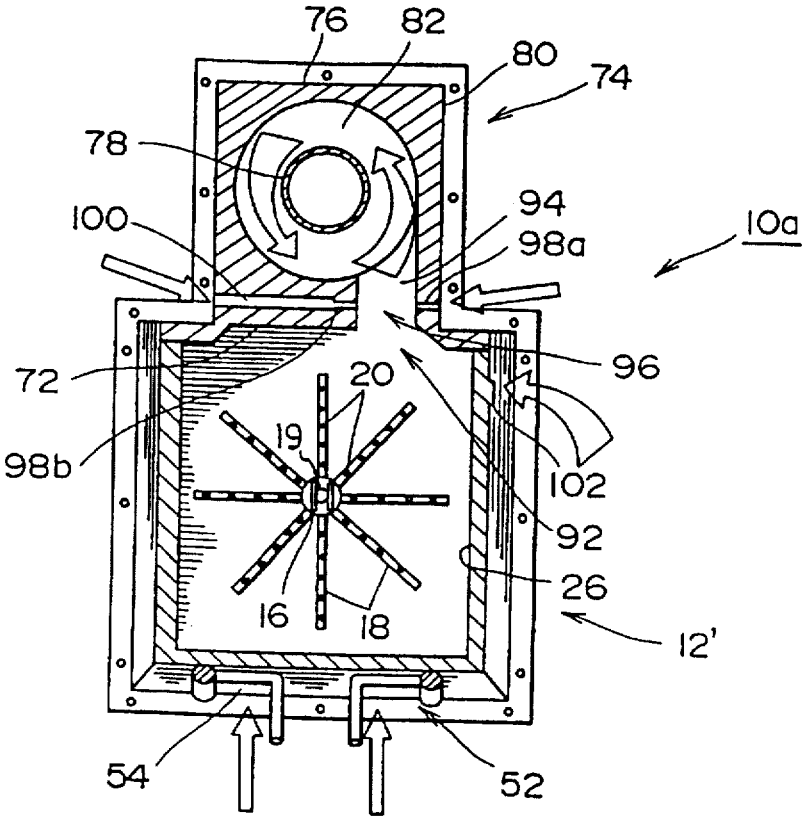
FIG. 7 is a somewhat simplified, partially cross-sectional, top-plan view of the incinerator apparatus along a line 7—7 in FIG. 6.

As shown in FIGS. 6 and 7, the cyclone section 74 is arranged adjacent to the partition wall 72. The partition wall 72 can be one wall of the furnace casing 26 of the furnace section 12', as shown, or can be an independent wall. The furnace section 12' and the cyclone section 74 communicate with each other through a communication opening 92 formed in the partition wall 72.

The cyclone burning and dust collecting section 74 includes a cyclone furnace 76 and is provided with a chimney 78 extending upward from substantially the center portion of the top wall of the cyclone furnace 76. The lower end of the chimney 78 extends downward into a cyclone chamber 82.

The cyclone furnace 76 is formed of an outer wall 80 of fireproof material, such as firebrick and castable refractory, which forms the cyclone chamber 82 which, in the illustrated embodiment, includes an upper cylindrical part and a lower conical part. As shown in FIG. 7, the cyclone section 74 has a generally square transverse cross-section, and its width is smaller than that of the furnace section 12'.

The outer surface of the wall 80 is covered with heat resistant metallic sheets, and the joint sections of such metal sheets may be reinforced with suitable means, such as an angled iron bar.

At the lower part of the cyclone chamber 82, there is a dust collector 84 into which dust carried in the combustion gas from the furnace section 12' into the cyclone section 74 falls down. Dust collected in the dust collector 84 is removed out through a window 86 (FIG. 8) which is normally closed by a door 88.

In this embodiment, the cyclone furnace 76 may be formed of any other refractory material, such as thick heat-resistant steel plates.

The chimney 78 is also formed of heat-resistant steel sheets, and its lower end, as previously described, extends into the cyclone chamber 82. The chimney 78 is supported by a post 90 standing vertically along the wall 80 of the cyclone section 74.

Figure 8:
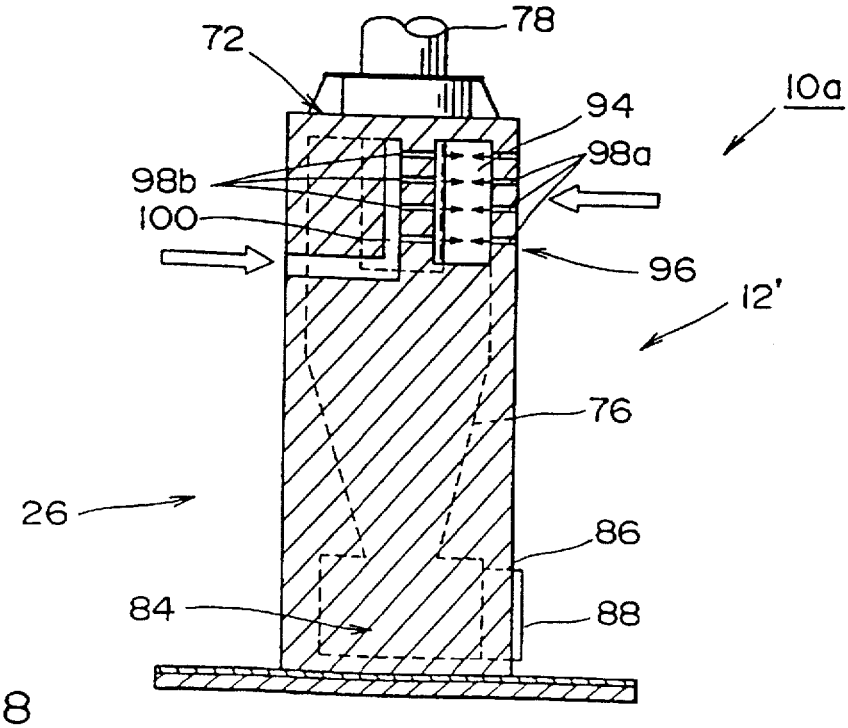
FIG. 8 is a cross-sectional view along a line 8—8 in FIG. 6.
Figure 9:
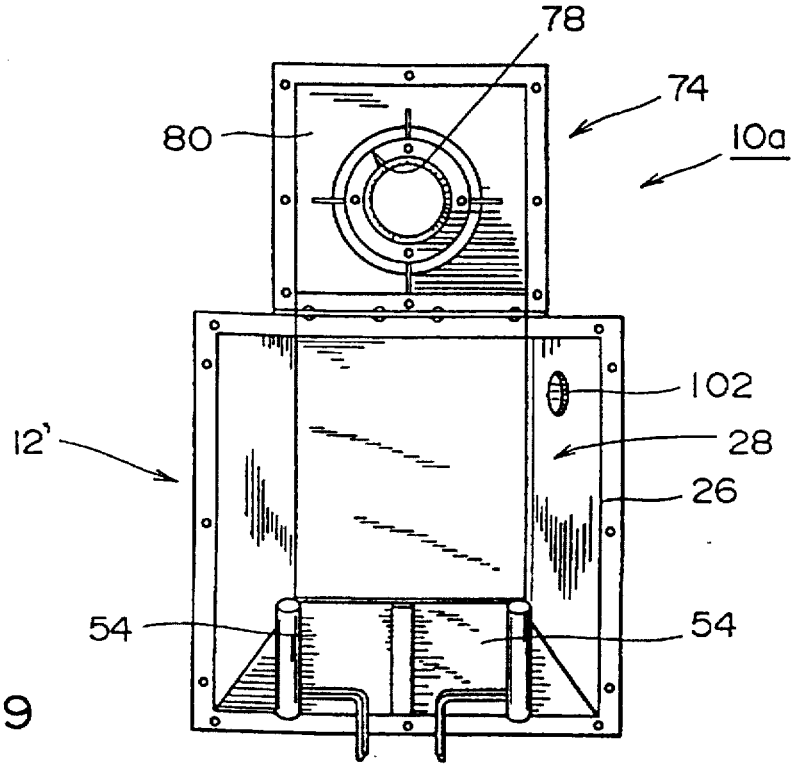
FIG. 9 is a plan view of the incinerator apparatus shown in FIG. 6.

As shown in FIGS. 6, 7, and 8, and as previously described, the communication opening 92 is formed in the upper end portion of the partition wall 72. A path 94 is formed in the wall of the cyclone section 74. The communication opening 92 in the partition wall 72 communicates with the path 94 so that the furnace section 12' and the cyclone section 74 communicate with each other. The path 94 opens into the cyclone chamber 82 at a location offset relative to the center axis of the cyclone section so that the combustion gas entering into the cyclone chamber 82 through the path can flow as a cyclone in the cyclone furnace 74. Thus, dust or soot in the combustion gas receives centrifugal force and collides with the inner conical wall of the chamber 82 so that it falls down along the inner wall into the dust collector 84.

In the wall of the cyclone furnace 76 in the vicinity of the communication opening 92, an air intake section 96 is provided to supply air to the combustion gas flowing into the cyclone furnace 76 through the furnace section 12'. In the illustrated embodiment, the air intake section includes air channels 98*a* which are arranged vertically in the wall 80 of the cyclone section 74 in one side of the path 94. Each of the air channels 98*a* opens into atmosphere at one end thereof so that external air can flow into the cyclone section 74 and is mixed with the combustion gas flowing into the upper portion of the cyclone chamber 82 from the furnace section 12'. Similar air channels 98*b* are provided in the wall 80 on the other side of the path 94. As shown in FIG. 7, if the thickness of the wall 80 is large, the air channels 98*b* (or 98*a*) may be formed to extend into the path 94 from an intermediate air chamber, such as an L-shaped chamber 100 shown in FIGS. 7 and 8, formed in the wall 80. The chamber 100 opens into the exterior of the incinerator apparatus.

The combustion gas produced from garbage burning in the furnace section 12' goes up toward the roof 28 and flows through the communication opening 92 into the path 94 in the cyclone section 74. When the gas flows through the path 94, air is supplied through the air channels 98*a* and 98*b* in the air intake section 96 and mixed with the combustion gas. The mixture of the combustion gas and air flows as a high speed cyclone in the cyclone furnace 76 so that the gas is subjected to secondary combustion, resulting in the perfect combustion of the gas.

In order to supply the combustion gas in the furnace section 12' with a sufficient amount of air, an air intake hole 102 is formed at a location along the flow of the gas in the furnace section 12' in such a manner that air from the exterior of the apparatus can flow into the furnace section toward the communication opening 92 and be mixed with the gas. In the illustrated embodiment, the hole 102 is formed in the right side wall of the roof 28.

Figure 10:
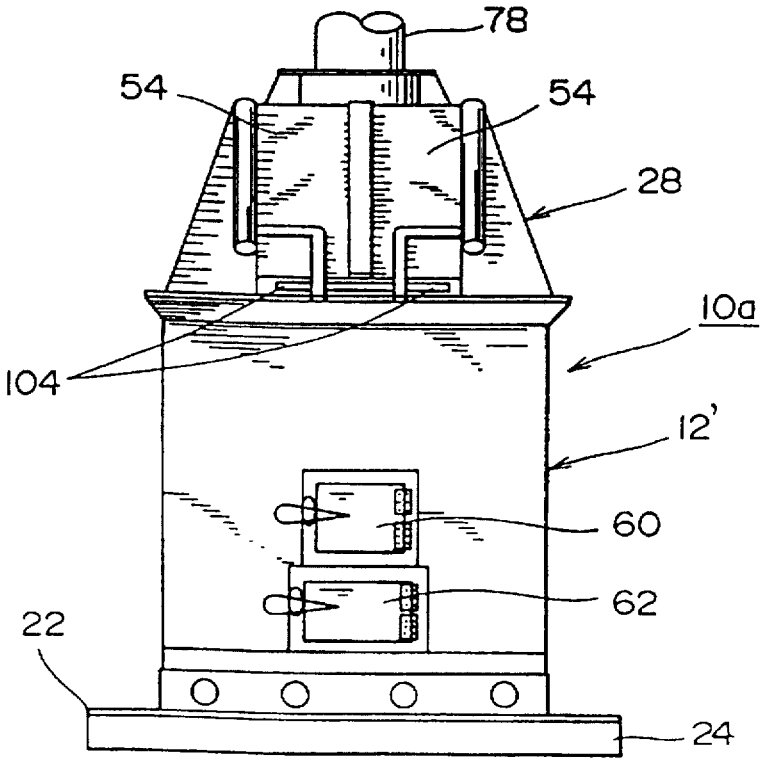
FIG. 10 is a front view of the incinerator apparatus shown in FIG. 6.

Another air intake hole, such as a slit 104 shown in FIG. 10, may be formed in the vicinity of the opening in the garbage dumping structure 52. The slit 104 is disposed in the lower portion of the structure 52.

Because the furnace section 12' and the cyclone section 74 are integral with each other with the partition wall 72 separating them from each other, the combustion gas resulting from burning garbage in the furnace section 12' enters directly into the cyclone furnace 76 through the opening 92 and the path 94 with substantially no decrease in temperature. In addition, air is supplied to the gas through the air intake section 96 while the gas flows through the path 94. Thus the combustion gas can be burned perfectly within the cyclone furnace 76 so that soot or dust which would otherwise be exhausted can be reduced greatly. Furthermore, by virtue of the cyclone produced in the cyclone chamber 82, soot or dust in the combustion gas is further reduced before the gas enters into the chimney 78.

The operation of the incinerator apparatus 10*a* is now described. The operation of the furnace section 12' is substantially the same as the furnace section 12 of the first embodiment. However, the gas, which flows directly into the chimney 14 in the first embodiment, flows through the path in the roof 28 toward the communication opening 92 in the partition wall 72. Air is supplied to the gas from the air intake holes 102 and 104. In addition, the gas, when it flows through the communication opening 92 and through the path 74 into the cyclone section 74, is supplied with additional air from the air channels 98*a* and 98*b*. The gas with air mixed therewith rotates at a high speed within the cyclone furnace 76 so that imperfectly burned gas in the combustion gas is perfectly burned.

Since the air intake channels 98*a* and 98*b* open into atmosphere, a sufficient amount of air for perfectly burning the combustion gas can be supplied automatically without resort to any powered air feeding apparatus. Thus, the total cost can be reduced.

Dust and soot contained in the combustion gas are separated by means of cyclone centrifugal force and fall down into the dust collector 84. Combustion gas free of dust or soot flows downward and enters from the lower end of the chimney 78 and flows upward, and clean combustion gas is exhausted from the chimney 78.

As stated above, since the furnace section 12' and the cyclone burning and dust collecting section 74 are made integral with each other, with the partition wall 72 disposed therebetween, the incinerator apparatus 10*a* of the second embodiment is simple in structure and, therefore, can be manufactured at a low cost. Furthermore, because the furnace section 12' and the cyclone section 74 are formed of heat resistant material, such as firebrick and castable refractory, the incinerator apparatus 10*a* can be used to burn up materials, such as plastic scraps, which require high temperature for burning.

The inventor has made experiments and found that in both the first and second embodiments, a practically satisfactory amount of air can be supplied so as to burn garbage well by using only the main pipe 16 with air holes 20 in its peripheral wall and the air hole 19 in its top end, with the branch pipes 18 removed. The inventor has found further that the use of a plurality of such main pipes 16 can provide a higher burning ability.

FIGS. 11–16 show an incinerator apparatus 210 according to a third embodiment of the present invention.

Figure 14:
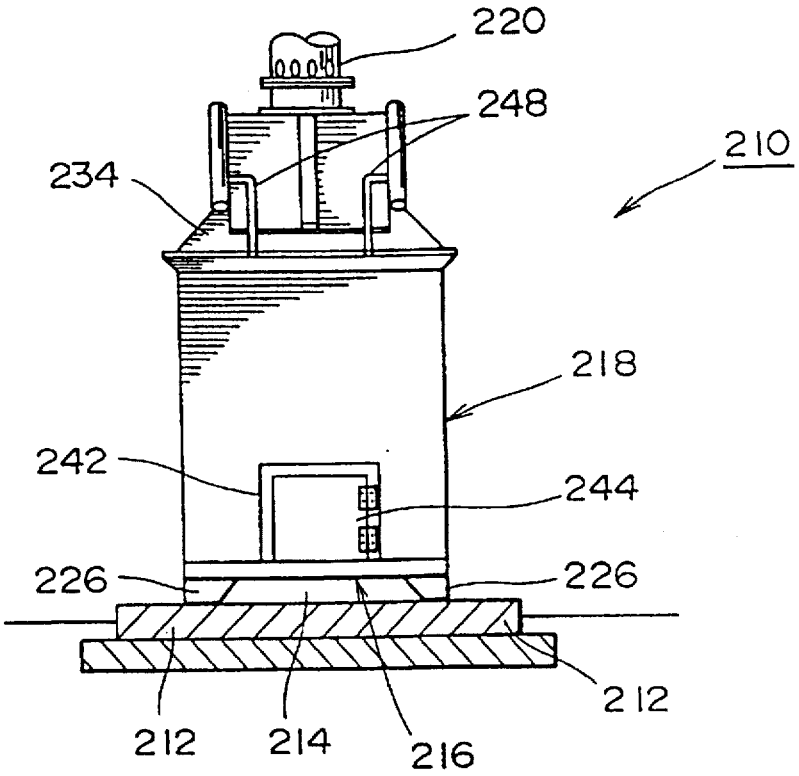
FIG. 14 is a front view of the incinerator apparatus according to the third embodiment of the present invention.
Figure 15:
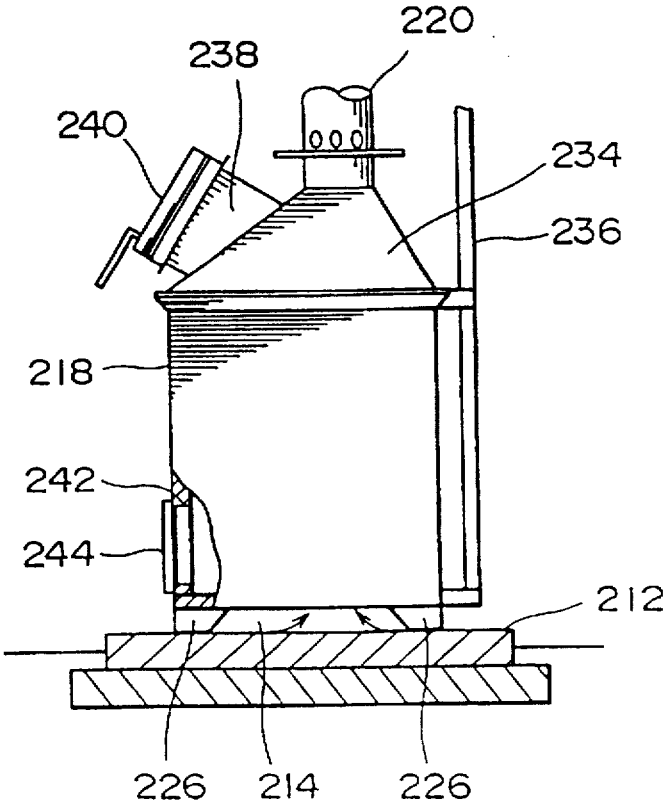
FIG. 15 is a side view of the incinerator apparatus according to the third embodiment of the present invention.
Figure 16:
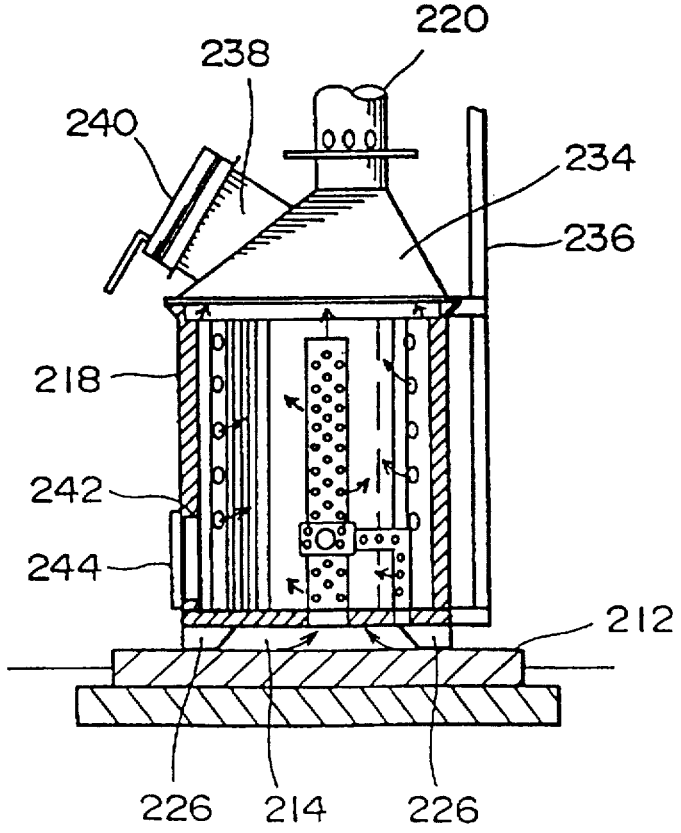
FIG. 16 is a partially cross-sectional side view of the incinerator apparatus according to the third embodiment.

As shown in FIG. 14, the incinerator apparatus 210 includes a furnace 218 and a chimney 220 mounted through a roof 234 disposed on the furnace 218 in communication with the furnace chamber of the furnace 218. The bottom section 216 of the furnace 218 is supported horizontal with a space 214 formed between the bottom section 216 and a floor 212 on which the apparatus 210 is installed. The chimney 220 of which only a portion is shown may be of the same structure as that of the chimney 14 of the first embodiment.

Figure 11:
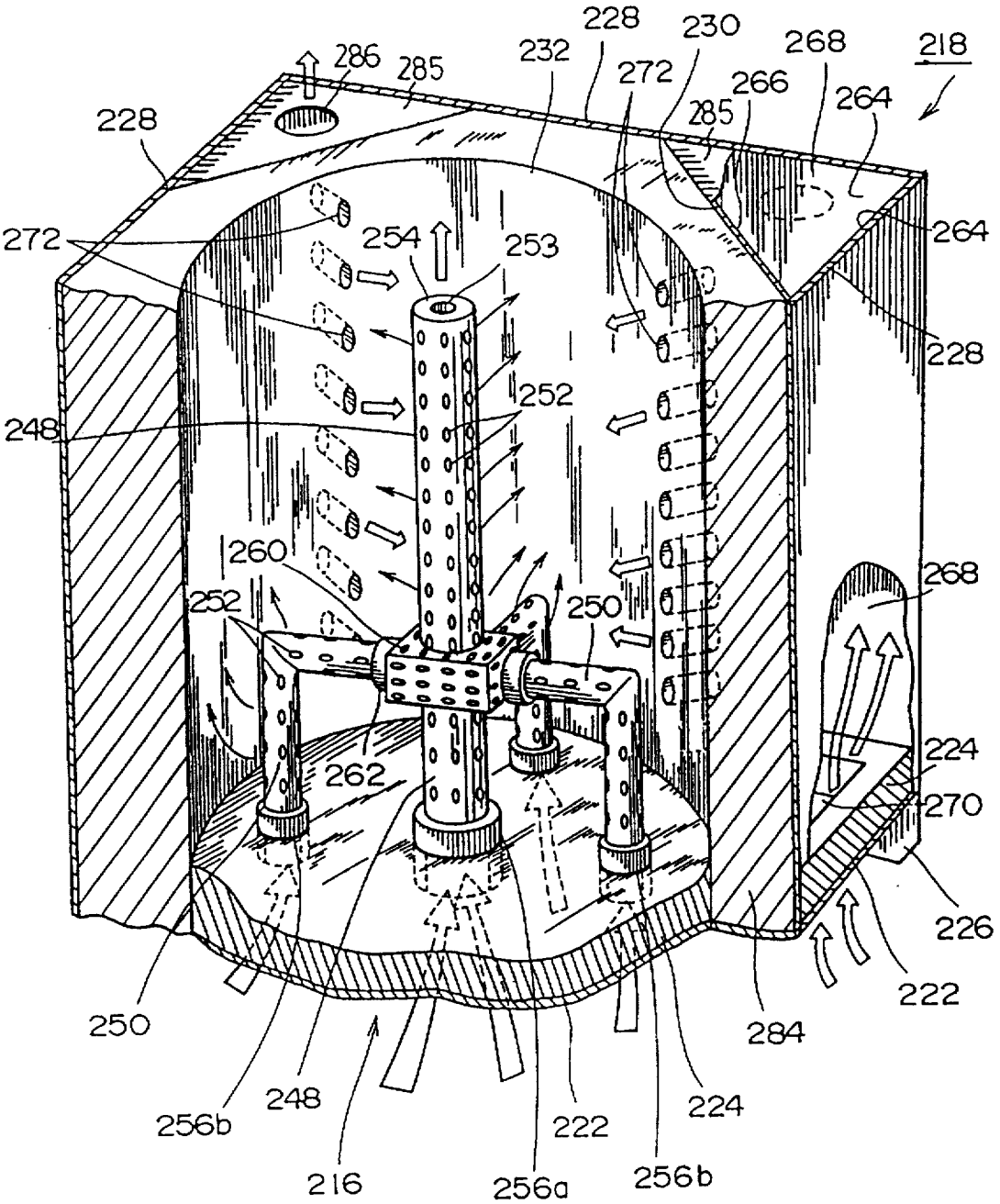
FIG. 11 is a partially cut-away, enlarged perspective view of part of an incinerator apparatus according to a third embodiment of the present invention.
Figure 12:
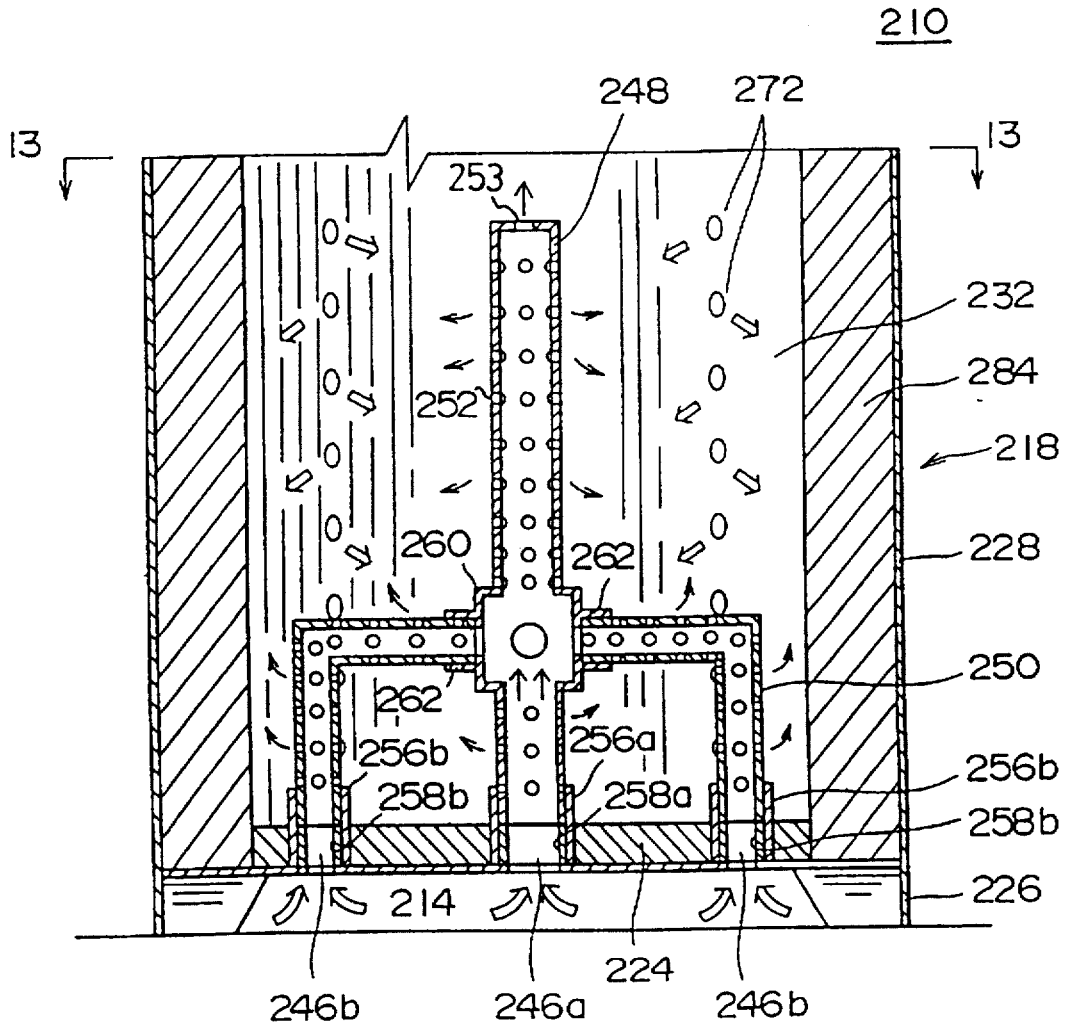
FIG. 12 is a cross-sectional view of part of the incinerator apparatus shown in FIG. 11.
Figure 13:
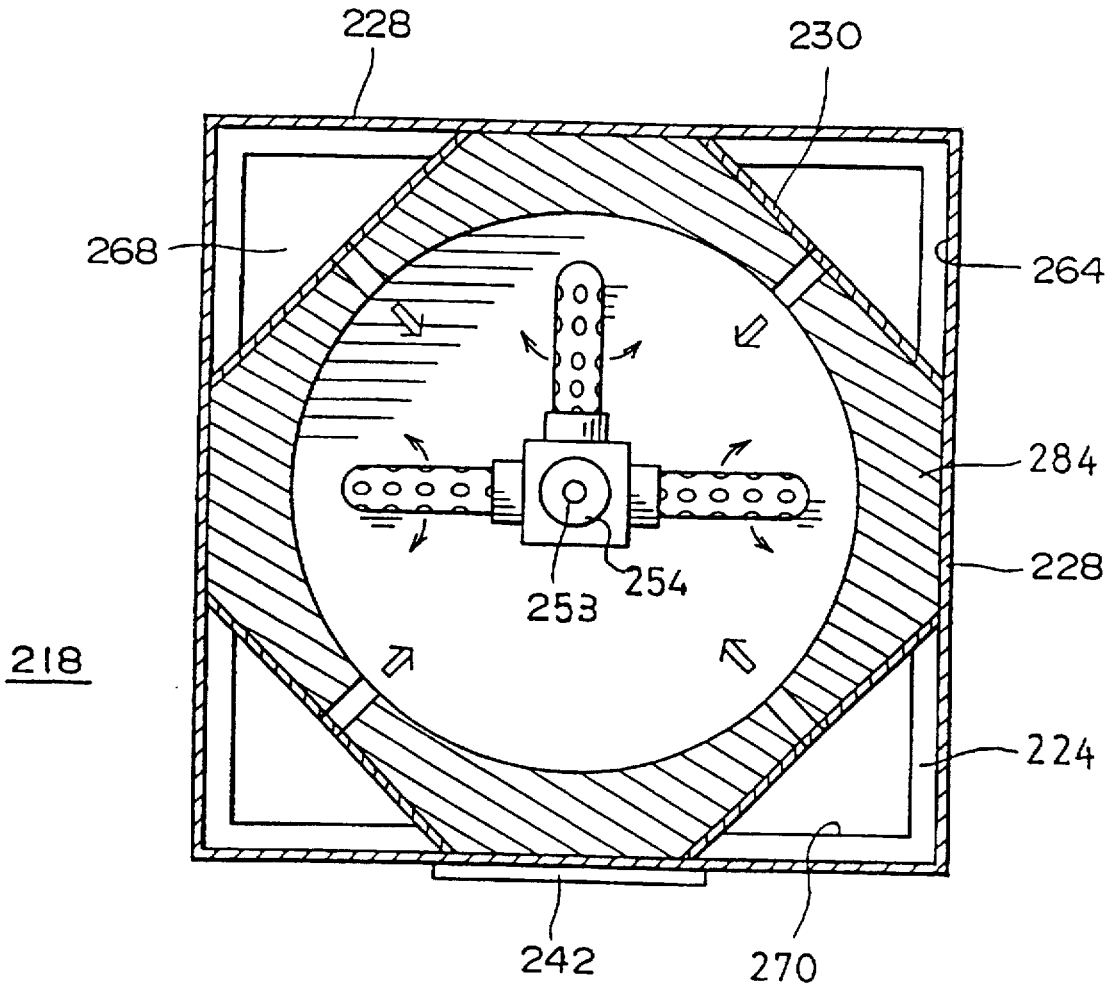
FIG. 13 is a cross-sectional view along a line 13—13 in FIG. 12.

As shown in detail in FIGS. 11, 12, and 13, the bottom section 216 comprises a substantially square heat-resistant metallic bottom plate 222 and a bottom member 224 of refractory material, such as firebrick and castable refractory, disposed on the top surface of the heat-resistant metal plate 222. At the four corners of the bottom section 226, supporting feet 226 are secured so that the bottom plate 222 is held horizontal and spaced from the floor to form the space 214.

The furnace 218 comprises heat-resistant peripheral metal plates 228 extending upright along the four sides of the metallic bottom plate 222 and being joined by, for example, welding, along adjacent edges to thereby form a box having four corners S. Alternatively, the box may be formed by a single metal plate 228. The furnace 218 further includes four heat-resistant metallic corner plates 230 disposed within the box formed of the metal plates 228. Each plate 230 faces one of the four corners S and is joined along its opposing edges to the metal plates 228. Thus, the four peripheral metal plates 228 and the four corner plates 230 are arranged to form a hollow prism having an octagonal cross-section. A refractory material, such as castable refractory, which can be the same material that is used for the bottom member 224, is disposed on the inner surface of the octagonal hollow prism to form a refractor wall 284 which provides a combustion chamber, such as a cylindrical chamber 232 shown. The shape of the furnace 218 is not limited to square in cross-section, but it may be circular or polygonal.

As shown in FIG. 12 and is seen in FIG. 11, air supply holes 246*a* and 246*b* are formed to extend through the bottom section 216. The air supply hole 246*a* is formed at substantially the center of the section 216, and the air supply holes 246*b* are located in the peripheral portion of the bottom section 216. These holes 246*a* and 246*b* make the combustion chamber 232 communicate with the outer space 214.

An air supply pipe system is disposed within the combustion chamber 232. The air supply pipe system comprises an air supply main pipe 248 extending upright from the center of the bottom member 224, and plural, three in the illustrated embodiment, air supply branch pipes 250 standing upright from locations in the peripheral portion of the bottom member 224. Similar to the main pipe 16 of the first and second embodiment, the main pipe 248 has a bore having a given transverse cross-sectional area over substantially the entire length thereof. The main and branch pipes 248 and 250 are provided with air supply holes 252 extending therethrough, from which air is supplied into the combustion chamber 232. The main pipe 248 is closed at its top end by a plate 254 having a top air hole 253 therethrough.

The lower ends of the air supply pipes 248 and 250 are removably supported by respective pipe support arrangements associated with the respective air supply holes 246*a* and 246*b*.

The lower end of the main pipe 248 is placed in communication with the air supply hole 246*a* at the center of the bottom member 224. The pipe support arrangement for the main pipe 248 includes a pipe support cylinder 256*a* fitted in and secured to the hole 246*a* and a cylindrical stop 258*a* securedly attached to the inner surface in the lower portion of the cylinder 256*a*. The upper end of the cylinder 256*a* extend into the combustion chamber 232.

The lower end of the main pipe 248 is removably fitted into the cylinder 256*a* until its bottom edge abuts the top edge of the cylindrical stop 258*a*. Thus, the main pipe 248 is supported by the cylinder 256*a* in such a manner that the pipe 248 can be withdrawn from the cylinder 256*a* when necessary.

The branch pipes 250 are connected in communication with the main pipe 248 at a mid portion thereof. Each of the branch pipes 250 extends horizontally in its portion closer to its end connected to the main pipe 248 and, then, bends downward at the point above one of the peripheral air supply holes 246*b*. The lower end of each of the branch pipes 250 is removably supported by a pipe support arrangement which comprises a pipe support cylinder 256*b* and a cylindrical stop 258*b*, similar to the pipe support arrangement for the main pipe 248.

As in the case of the main pipe 16 of the first and second embodiment, the diameter of the top air hole 253 in the plate 254 at the top of the main pipe 248 is smaller than the inner diameter of the main pipe 248, but it is typically larger than the diameter of the air holes 252 in the peripheral walls of the main and branch pipes 248 and 250. With this air supply system, when garbage in the furnace chamber is burning, air flowing from the outer space 214 into the respective pipes 248 and 250 is heated to form an updraft, and flows smoothly out of the pipes through the top air hole 253 toward the chimney. As air flows out through the top air hole 253, air also flows out into the furnace chamber through the air holes 252 to thereby supply sufficient air into the furnace chamber.

As in the case of the air hole 19 in the plate 44 at the top end of the main pipe 16 of the first and second embodiments, the amount of air flowing into the combustion chamber 232 through the air holes 252 becomes largest when the diameter of the top air hole 253 is properly chosen. The appropriate diameter of the top airhole 253 can be determined empirically for particular sizes of incinerator apparatuses. However, the ratio in transverse cross-sectional area of the top air hole 253 to the main pipe 248 is theoretically between about 10% and about 2%.

As is seen from FIGS. 11 and 12, an air box 260 is disposed at a predetermined height of the main pipe 248. The width and length of the upper and lower plates of the box 260 are larger than the diameter of the pipe 248. Ring-shaped holders 262 for holding the respective branch pipes 250 are formed to protrude horizontally from three side plates, namely, two lateral and rear side plates of the air box 260. The ends of the branch pipes 250 are removably fitted into the respective ring-shaped holders.

Garbage dumped into the combustion chamber 232 is supported by the radially extending branch pipes 250, and, when garbage is burned, air are supplied from the space 214 through the main and branch pipes 248 and 250 and through air holes 252 formed through the respective main and branch pipes 248 and 250 into the chamber 232 and garbage within the chamber 232.

As garbage burns to ash, ash can fall down through the spaces between adjacent branch pipes 250 without closing the spaces so that garbage can be burned perfectly and no or little soot is discharged through the chimney 220.

The air supply main pipe 248 and the branch pipes 250 can be withdrawn from the respective support cylinders 256*a* and 256*b*, and, then the branch pipes 250 are withdrawn from the ring-shaped holders 262. Then, the pipes 248 and 250 can be taken out through a garbage dumping opening 238 in the roof 234 for cleaning and maintenance. Ash and residues of garbage in the combustion chamber 232 are removed through an ash removal window 242. A door 240 normally closes the garbage dumping opening 238, and a door 244 normally closes the ash removal window 242.

As is seen from FIGS. 11 and 13, at each corner of the furnace 210, a pyramidal air path 268 having a triangular cross-sectional shape is formed by two peripheral metal plates 228 and one corner plate 230. Each of the air paths 268 extends from the bottom section 216 up to the top end of the furnace 218. An air flowing hole 270 is formed in the bottom section 216 at the bottom of each air path 268. The upper end of each air path 268 is closed by a plate 285 having an air hole 286. A number of air channels 272 extend from the air path 268 through the wall 284 of the combustion chamber 232 into the chamber 232 at vertically arranged points along the inner surface of the wall 284.

When garbage dumped into the combustion chamber 232 is burning, external air flows upward from each of the holes 270 in the bottom section 216 through the air path 268, and, then, flows through each of the air channels 272 into the combustion chamber 232 to facilitate perfect burning of garbage.

The cross-sectional area of the air hole 286 in each plate 285 is smaller than that of the air path 268. The diameter of the air hole 286, however, is typically larger than that of the air channels 272, which is, for example, 1.5 cm. When garbage in the combustion chamber is burning, air flowing from the space 214 into the air paths 268 is heated to form an updraft. The heated air smoothly goes out of the air paths 268 through the air holes 286 and flows upward to the chimney. As air flows out through the air holes 286, air also flows through the air channels 272 into the combustion chamber 232 so that combustion is accelerated. As in the case of the top air hole 253 and the air hole 19 in the first and second embodiments, the amount of air flowing into the combustion chamber 232 through the air channels 272 is largest when the air holes 286 are appropriately sized. With a larger cross-sectional area of the air paths 268, the proper cross-sectional area of the air holes 286 is larger. However, the ratio in cross-sectional area of the air holes 286 to the air paths 268 tends to become smaller as the cross-sectional area of the air paths 268 becomes larger. The diameter of the air holes 286 is also determined empirically for particular types and sizes of incinerator apparatus. The inventor made experiments and found that for the air paths 268 having a cross-sectional area of about 22 $cm^2$, the optimal cross-sectional area of the air holes 286 was about 1.8 $cm^2$, and for the air paths 268 having a cross-sectional area of about 134 $cm^2$, the optimal cross-sectional area of the air holes 286 was about 3.1 $cm^2$. The optimal cross-sectional area of the air holes 286 for the air paths 268 having a cross-sectional area between about 22 $cm^2$ and about 134 $cm^2$ was between about 1.8 $cm^2$ and about 3.1 $cm^2$. Thus, the ratio in cross-sectional area of the air holes 286 to the air paths 268 was between about 8% and about 2%.

The inventor has found that a satisfactory amount of air can be supplied even when the main pipe 248 and the air paths 268 only are used, with the air supply holes **246*b* and the branch pipes 250 removed. It has been also found that more or less satisfactory results can be obtained by substituting pipes similar to the main pipe 248 for the branch pipes 250**.

Figure 17:
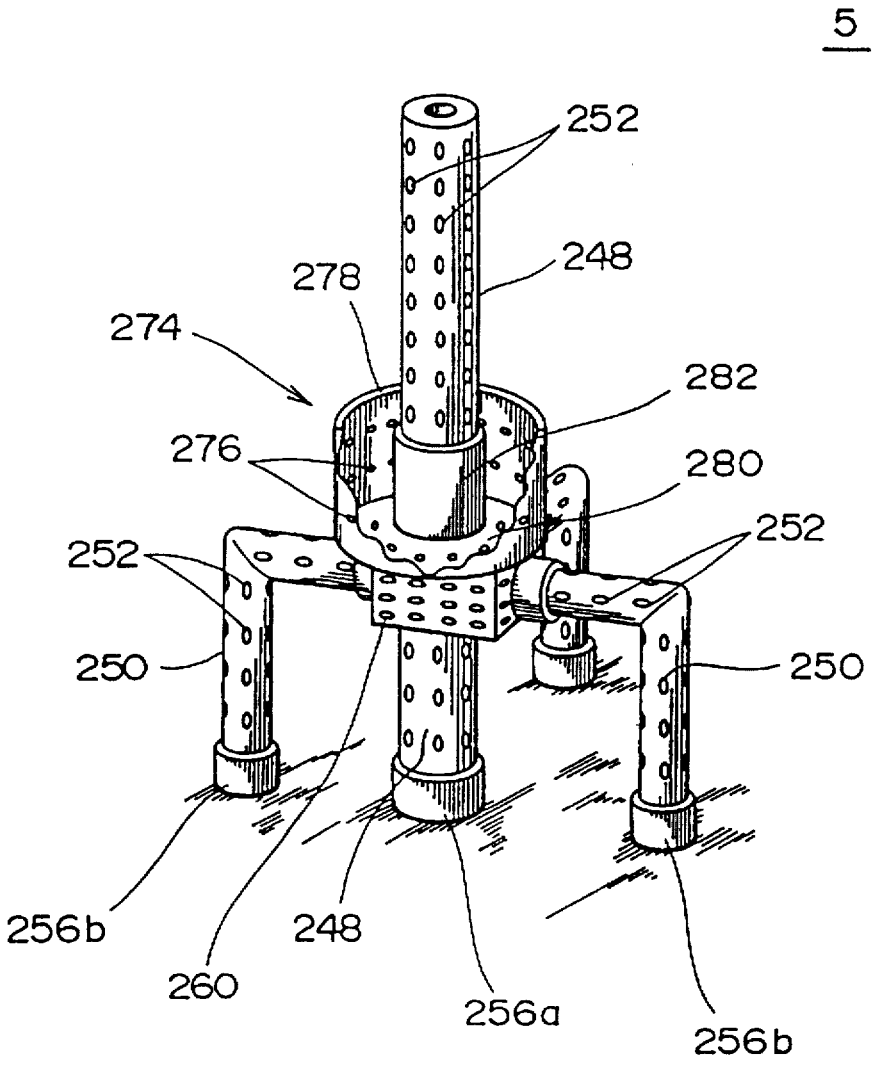
FIG. 17 is a partially broken perspective view of an air supply pipe system employed in the apparatus shown in FIGS. 11–15, in which a sterilizer is attached to the air supply pipe system.

As shown in FIG. 17, a sterilizer 274 may be mounted to the air supply main pipe 248. The sterilizer 274 is removably mounted to the pipe 248. The sterilizer is cup-shaped with its upper end open and may be formed of a heat-resistant material, such as iron and ceramics. The sterilizer 274 includes a wall plate 278 and a bottom plate 280. Air holes 276 are formed through the wall plate 278 and the bottom plate 280. The sterilizer further includes a sleeve 282 which extends upward from substantially center portion of the bottom plate 280. The sleeve 282 is telescopically fitted over the main pipe 248 as shown. Thus, the sterilizer 274 is placed over the main pipe 248 which is inserted into the aperture of the sleeve 282 until the bottom of the sterilizer rests on the air box 260.

For example, injector needles, scalpels, and the likes which have been used for treatment in hospitals may be placed in the sterilizer 274. The sterilizer 274, then, is placed over the pipe 248, with the bottom thereof resting on the air box 260. The injector needles and scalpels, thus, can be sterilized by heat and flames produced by burning garbage.

Figure 18:
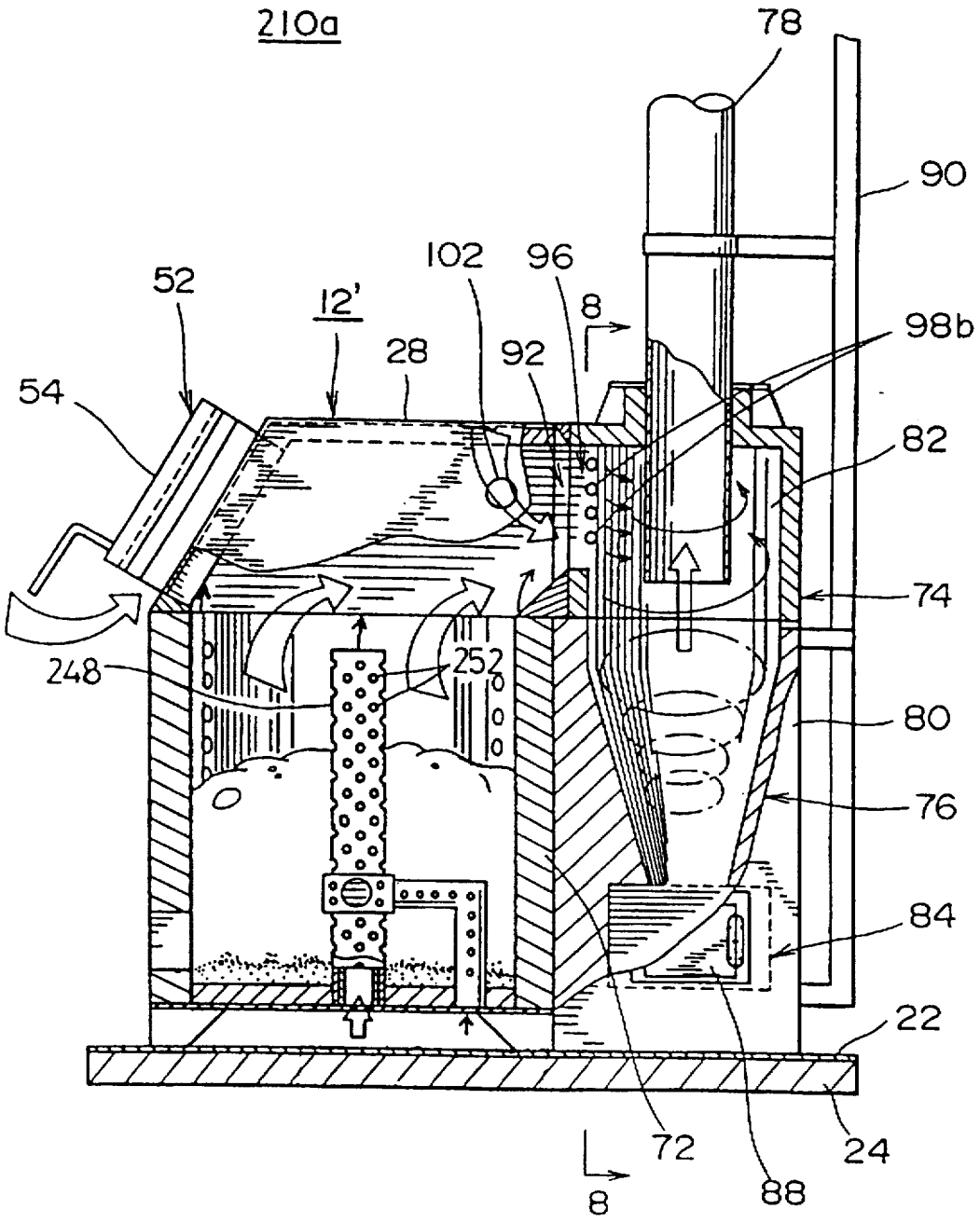
FIG. 18 is a partially cross-sectional side view of an incinerator apparatus according to a fourth embodiment of the present invention.

FIG. 18 shows an incinerator apparatus **210*a* according to a fourth embodiment of the present invention. The incinerator apparatus 210*a* comprises a furnace which is substantially the same as the furnace 218 of the third embodiment described with reference to FIGS. 11 through 16, and a cyclone burning and dust collecting section which is substantially the same as the cyclone burning and dust collecting section 74 described with reference to FIGS. 6 through 10. Accordingly, the same reference numerals used in FIGS. 6 through 16** are used for the similar components and functions, and their description is not made. Further, the operation and results obtained will be easily understood from the description of the first through third embodiments, and, therefore, they are not described.

Garbage consisting of wasted plastic scraps and corrugated-cardboard pieces in a ratio of 1:1 was burned in the incinerator apparatus of the present invention. It was confirmed that exhausted combustion gas contained little smoke.

Sizes of various part of a typical example of the incinerator apparatus shown in FIG. 2 are as follows.

The height of the incinerator inclusive of the chimney is 705 cm.

The diameter of the chimney is 20 cm.

The outer dimensions of the furnace are 125.5 cm in height, 61.5 cm in width, and 111.5 cm in depth.

The inner dimensions of the furnace are 109.0 cm in height, 47.5 cm in width, and 47.5 cm in depth.

The thickness of the wall of the furnace is 5.0 cm. The wall is of castable refractory comprising alumina cement and heat-resistant firebrick particles.

The main and branch air supply pipes are made of iron.

The length of the main pipe is 35.0 cm.

The diameter of the main pipe is 6.05 cm.

The diameter of the air holes in the main pipe is 1.0 cm.

The spacing between longitudinally adjacent air holes in the main pipe is 4.7 cm.

The angular spacing between adjacent air holes at the same height in the main pipe is 90 degrees.

The length of the branch pipes is 40.0 cm.

The diameter of the branch pipes is 1.0 cm.

The diameter of the air holes in the branch pipes is 0.5 cm.

The angular spacing between adjacent air holes in the branch pipes is 90 degrees. (No air hole is present at a location opposite to one air hole.)

It should be noted that the present invention is not limited by the above descriptions but can be modified within the scope of the appended claims.

What is claimed is:

1. Incinerator apparatus comprising:

a furnace having a peripheral wall and a bottom section supported horizontal with a space formed between said bottom section and a floor on which said furnace is installed, said peripheral wall and said bottom section forming a furnace chamber, said bottom section being capable of carrying thereon matters to be burnt and ash resulting from burning matters;

a chimney communicating with said furnace chamber at a location in an upper portion thereof;

an air supply hole extending through said bottom section to communicate with said space; and an air supply pipe extending upward within said furnace chamber, with the lower end of said air supply pipe being connected to communicate with said air supply hole in said bottom section, said air supply pipe having a bore having a given transverse cross-sectional area over substantially the entire length thereof:

wherein:

said air supply pipe has a plurality of air holes extending through the peripheral wall thereof, said air holes being distributed over substantially the entirety of said peripheral wall;

said bore having a reduced transverse cross-sectional area at the top end of said air supply pipe to form a top air hole, the ratio of said reduced transverse cross-sectional area of said top air hole to the area of said given transverse cross-sectional area of said bore being from about 2% to about 10%, said top air hole having a larger cross-sectional area than said air holes;

the upper portion of said furnace chamber above said top air hole in said air supply pipe including substantially no obstacles to the flow of air flowing out through said top air hole.

2. The incinerator apparatus according to claim 1 further comprising at least one branch pipe communicating with said air supply pipe and extending toward said peripheral wall of said furnace, said branch pipe having a plurality of air holes extending through the peripheral wall thereof so that air from said air supply pipe can flow out through said plurality of air holes into said furnace chamber.

3. The incinerator apparatus according to claim 1 wherein said chimney is provided with an air supply section, said air supply section comprising:

an air supply chamber formed by a cylindrical wall around the chimney, air introducing openings formed in said cylindrical wall, and air supply openings formed in the part of said chimney surrounded by said air supply chamber.

4. The incinerator apparatus according to claim 1, further comprising:

a cyclone burning and dust collecting section formed integral with said furnace with a partition wall disposed therebetween, said partition wall having a communication opening formed therein, said furnace and said cyclone burning and dust collecting section communicating with each other through said communication opening in said partition wall;

said cyclone burning and dust collecting section comprising a cyclone furnace having a cyclone chamber;

an air intake section for supplying air from outside into said cyclone chamber being disposed near said communication opening;

said chimney being mounted to said cyclone burning and dust collecting section at substantially the center of said cyclone burning and dust collecting section, with the lower end of said chimney extending into said cyclone chamber.

5. The incinerator apparatus according to claim 1 further comprising:

at least one peripheral air supply hole extending through said bottom section in the periphery of said bottom section to communicate with said space between said bottom section and said floor; and a peripheral air supply pipe having one end communicating with said peripheral air supply hole and extending upward in said furnace chamber, said peripheral air supply pipe having a plurality of air holes extending through the peripheral wall thereof.

6. The incinerator apparatus according to claim 1 wherein:

at least one air path is formed to extend upward outside said peripheral wall of said furnace, said air path having an upper end communicating with the upper portion of said furnace chamber and having a lower end communicating with said space between said bottom section and said floor;

a plurality of air channels are formed through said peripheral wall of said furnace so that said furnace chamber and said air paths communicate with each other; and said air path has its transverse cross-sectional area reduced at the top thereof to provide a top air hole.

7. The incinerator apparatus according to claim 6 wherein the ratio of said reduced transverse cross-sectional area of said air path to said given transverse cross-sectional area of said air path is from about 2% to about 10%.

* * * * *